United States Patent [19]

Heil

[11] 4,039,044

[45] Aug. 2, 1977

[54] LOW FREQUENCY ELECTRO-ACOUSTIC TRANSDUCER WITH INTERCONNECTED DIAPHRAGMS INTERLEAVED WITH FIXED DIAPHRAGMS

[76] Inventor: Oskar Heil, 1775 Parrott Drive, San Mateo, Calif. 94402

[21] Appl. No.: 658,812

[22] Filed: Feb. 17, 1976

Related U.S. Application Data

[63] Continuation of Ser. No. 526,667, Nov. 25, 1975, abandoned.

[51] Int. Cl.[2] ..... H04R 1/02; H04R 7/02

[52] U.S. Cl. ..... 181/144; 181/163; 181/199; 179/116

[58] Field of Search ..... 179/181 R, 116; 181/144, 145, 147, 148, 157, 161, 162, 163, 164, 171, 173, 174

[56] References Cited

U.S. PATENT DOCUMENTS

| | | | |
|---|---|---|---|
| 1,672,796 | 6/1928 | Whitmore | 179/181 R |
| 1,702,399 | 2/1929 | Beidler | 181/163 |
| 1,733,013 | 10/1929 | Hibalsko | 181/171 |
| 1,738,575 | 12/1929 | Greswold | 181/171 |
| 1,969,704 | 8/1934 | D'Alton | 181/160 |
| 2,864,899 | 12/1958 | Parker | 179/111 R |
| 3,636,278 | 1/1972 | Heil | 179/115.5 PV |
| 3,669,214 | 6/1972 | Matsuura et al. | 181/164 |

FOREIGN PATENT DOCUMENTS

| | | | |
|---|---|---|---|
| 434,856 | 10/1926 | Germany | 179/111 R |

*Primary Examiner*—George G. Stellar
*Attorney, Agent, or Firm*—Robert R. Tipton

[57] ABSTRACT

An electro-acoustic transducer for low frequencies ranging from 0-5000 Hz uses a plurality of parallel spaced apart, alternately disposed, fixed and movable diaphragms, in addition to which the motion inducing forces on the movable diaphragm are distributed over the area of the diaphragm and assembly of the electro-acoustic transducer is achieved by the use of modular elements.

1 Claim, 20 Drawing Figures

50

LOW FREQUENCY ELECTRO-ACOUSTIC TRANSDUCER WITH INTERCONNECTED DIAPHRAGMS INTERLEAVED WITH FIXED DIAPHRAGMS

CROSS-REFERENCE TO RELATED APPLICATION

This application is a continuation of application Ser. No. 526,667, filed Nov. 25, 1975, now abandoned.

BACKGROUND OF THE INVENTION

This invention relates generally to acoustic transducers and in particular to electro-acoustic transducers in the low frequency range.

The basic principle of the present invention is disclosed in applicant's prior U.S. Pat. No. 3,636,278, issued Jan. 18, 1972.

The present invention represents an improvement on the basic concept and a specific configuration and method of construction for such a sound reproduction device in the low frequency range from about 0 to 5000 Hz. Coverage of this range might also be accomplished using two electro-acoustic transducers using the concept of the present invention with one dimensioned to produce sound in the 0–500 Hz range and the other to produce sound in the 500–5000 Hz range.

Prior to the invention of the electro-acoustic transducer disclosed and claimed in applicant's prior issued patent, the majority of transducers used to produce sound in the low frequency range utilized light weight cones driven by a coil attached to a cylinder suspended in a magnetic field.

In such devices, and for that matter in any vibrating diaphragm driven by a motion inducing force located at one point or at a small area on the diaphragm, all parts of the diaphragm will not be moving in the same direction with the same velocity for the same distance or at the same time due to the flexibility of the diaphragm material as well as the assymetric forces at the point of attachment of the diaphragm to the surrounding frame and the inertial forces of the air against the diaphragm.

The prior art methods used to correct the above problems usually resulted in a configuration of foam plastic filled cones in which the base of the cone was used as the air driving surface and the apex of the cone as the point of application of the motion inducing force. Such a configuration generally required large driving forces to overcome the inertial forces of the large mass of the foam filled cone.

SUMMARY OF THE INVENTION

The electro-acoustic transducer or sound reproduction device of the present invention utilizes a plurality of alternately disposed, generally parallel arranged, fixed and movable diaphragms with means for moving the movable diaphragms alternately toward and away from the fixed diaphragms with the forces applied by the means for moving the diaphragm distributed over the surface of the diaphragm.

It is, therefore, an object of the present invvention to provide an electro-acoustic transducer.

It is another object of the present invention to provide an electro-acoustic transducer in the low frequency range from 0 to 5000 Hz.

It is a further object of the present invention to provide an electro-acoustic transducer in which the forces applied to the movable diaphragms are distributed over the area of the diaphragm.

It is a further object of the present invention to provide an electro-acoustic transducer having a negative feedback characteristic.

It is still a further object of the present invention to provide an electro-acoustic transducer having low harmonic distortion.

It is yet another object of the present invention to provide an electro-acoustic transducer of modular construction.

These and other objects of the present invention will be manifest upon study of the following detailed description when taken together with the drawings.

DESCRIPTION OF THE PREFERRED EMBODIMENTS

Figure 1:
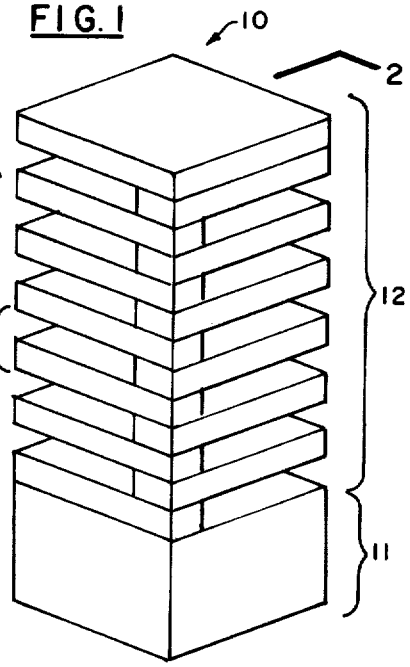
FIG. 1 is an isometric view of the basic configuration of the electro-acoustic transducer of the present invention.

With reference to FIG. 1, the low frequency electro-acoustic transducer device 10 of the present invention comprises, basically, a driver section 11 on which is mounted an acoustic transducer or air motion transformer section 12 comprising a plurality of modular transducer assemblies 14.

Figure 2:
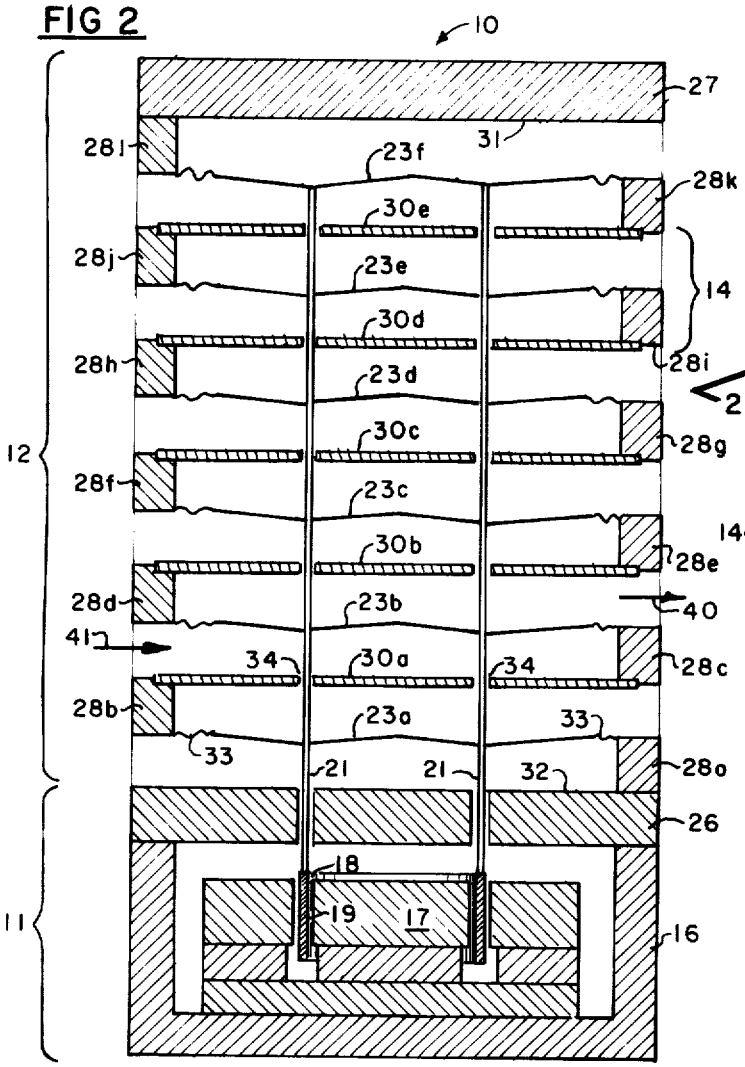
FIG. 2 is an elevational sectional view of the electro-acoustic transducer of the present invention taken at line 2—2 of FIG. 1.

With reference to FIG. 2, driver section 11 comprises a housing 16 containing permanent magnet assembly 17 having an air gap 18 in which is suspended driving coil 19.

Attached to driving coil 19 are a number of drive rods 21 which are distributed uniformly about the periphery of drive coil 19 and are also connected along their length to movable diaphragms 23*a* through 23*f*.

Acoustic transducer or air motion transformer section 12 comprises, bascially, a bottom end block 26 and a top end block 27 in between which are disposed modular transducer assemblies 14 which, in turn, comprise diaphragm spacer blocks 28*a* through 281 which are connected, on one side, to movable diaphragm 23 (one of diaphragms 23*a* - 23*f*), and on the other side to fixed diaphragm 30 (one of diaphragms 30*a* - 30*e*).

When assembled, modular transducer assemblies 14 thus define a plurality of narrow air spaces having openings alternately facing in opposite directions.

To maintain movable diaphragms 23*a* - 23*f* in spaced apart relation to fixed diaphragms 30*a* - 30*e* and the inside surfaces 31 and 32, respectively, of bottom and top end blocks 27 and 26, a flexible membrane 33 is connected between spacer blocks 28*a* - 281 and the periphery of movable diaphragms 23*a* - 23*f*.

Drive rods 21 can be fabricated from any light weight rigid material. Satisfactory results have been achieved using narrow paper cylinders similar to "soda straws" which have good compression and tensile strength properties.

To permit interconnection of movable diaphragms 23*a* - 23*f*, a hole 34 is provided in fixed diaphragms 30*a* - 30*e* which are adapted to accommodate and be spaced apart from drive rods 21.

Figure 3:
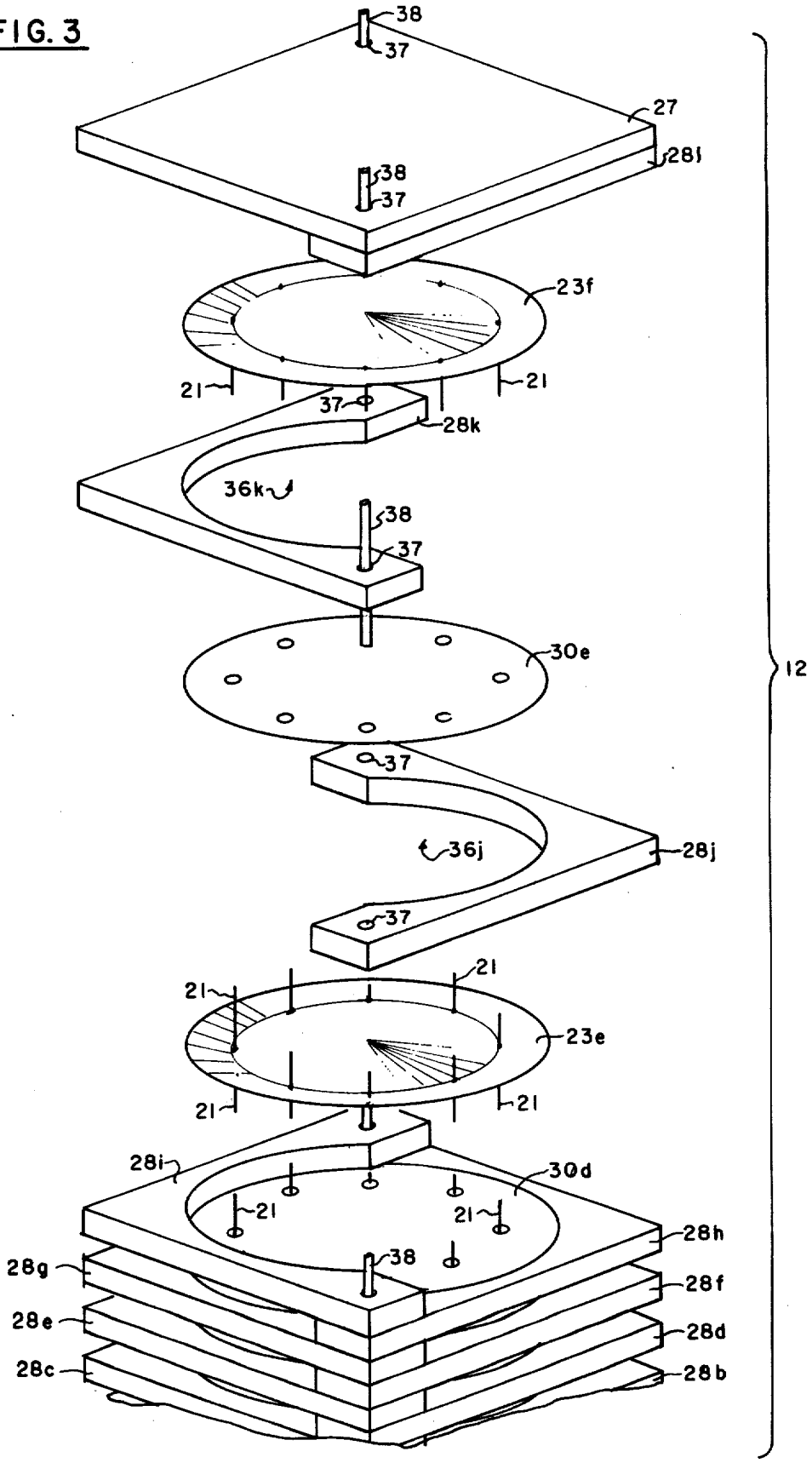
FIG. 3 is an isometric exploded view of the electro-acoustic transducer of the present invention showing the method of assembly of the device.

With reference to FIG. 3, there is illustrated an exploded view of acoustic transducer section 12 of FIG. 2 showing the method of assembly and shape of the parts in greater detail.

In particular, diaphragm spacer blocks 28 generally comprise a top and bottom surface surrounding a section of a circular opening 36 and adapted to receive and be attached to movable diaphragm 23 on one side and fixed diaphragm 30 on the other side. Spacer block 28 is fabricated out of a generally rectangular block in which a major portion of one corner is removed leaving three corners, two of which are provided with alignment and assembly holes 37 which are adapted to receive tension rods 38 to hold the entire transducer device together.

As can be seen from FIG. 3, each adjacent spacer block is placed with its open side facing in the opposite direction.

Operation of the electro-acoustic transducer of the present invention can be seen from FIG. 2, which operation is basically one of applying an alternating direction force to diaphragms 23*a* - 23*f* causing then to move alternately toward and away from fixed diaphragms 30*a* - 30*e* to drive air in and out of the space betwen each diaphragm 30*a* - 30*e* and movable diaphragm 23*a* - 23*f*, respectively.

For example, when movable diaphragm 23*b* moves upward toward fixed diaphragm 30*b*, there is a compression of the air mass between diaphragms 23*b* and 30*b* above diaphragm 23*b* causing a flow of air out of the cavity as indicated by arrow 40, while, at the same time, there is a rarefaction of the air mass between diaphragms 23*b* and 30*a*, below diaphragm 23*b*, causing a flow of air into the cavity as indicated by arrow 41.

Thus, in accordance with the applicant's prior patent, a large amount of air is moved with relatively small amount of kinetic energy of the moving parts of the speaker.

However, to achieve ideal sound reproduction, each movable diaphragm 23*a* - 23*f*, as well as the whole assembly of diaphragms including drive rods 21, must operate as a rigid unit. In addition, any distortion caused by the flapping of the unsupported portion of diaphragms 23*a* - 23*f*, longitudinal elastic deformation of drive rods 21 and assymetric forces caused by the flexible membrane connection between the movable diaphragms and the spacer blocks must be corrected or eliminated.

To increase the rigidity of movable diaphragms 23*a* - 23*f*, they have, for the embodiment shown in FIGS. 1 - 3, been fabricated in the form of two concentric conical section with drive rods 21 attached to each movable diaphragm at the intersection of the two conical sections.

Figure 4:
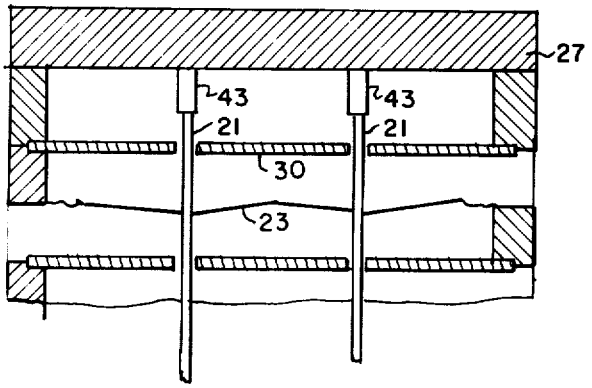
FIG. 4 is a partial elevational section of the electro-acoustic transducer of the present invention showing a method of terminating the diaphragm drive rods.

To dampen longitudinal resonance in rods 21, a terminator 43, shown in greater detail in FIG. 4, is connected between the ends of rods 21, distal driving coil 19, the top end block 27.

Terminator 43 comprises a generally resilient material having some viscous properties sufficient to dampen any reflected longitudinal vibrations in rods 21.

It has been found that, of the total energy required to drive the movable diaphragms of the present invention, three-quarters of the energy is transferred to the air mass and one-quarter is used to accelerate and decelerate the mass of the diaphragms, coil and drive rods.

Although not large, there are reaction forces acting upon magnetic assembly 17 and the rigid structure comprising housing 16 and the rigid frame work of air motion transformer section 12 which can cause the unit to vibrate.

Figure 2A:
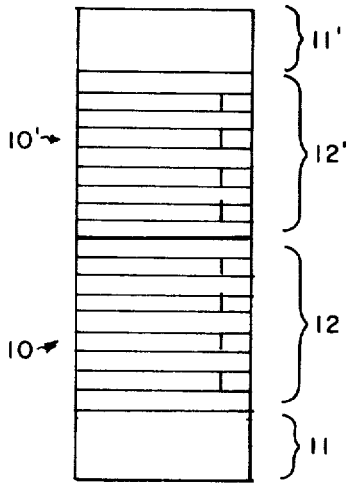
FIG. 2A is an elevational view of the double ended drive speaker assembly.

One technique for counteracting such vibration problems is to provide a double ended drive unit such as shown in FIG. 2A. For example, by placing two acoustic devices together with either the two driver units 11 and 11' end-to-end, or the two air motion transformer units 12 and 12' end-to-end, as shown in FIG. 2A, and with each driver unit 11 and 11' connected to operate push-pull, that is, the movable diaphragms in transformer unit 12 and 12' are caused to move simultaneously toward and away from each other, the vibratory forces in one unit will counteract the vibratory forces in the other unit.

A more complete embodiment of the present invention is illustrated in FIGS. 5, 6, 7 and 8 which utilizes a rectangular movable diaphragm and a fixed diaphragm incorporated into the means for spacing apart the movable diaphragms.

Figure 6:
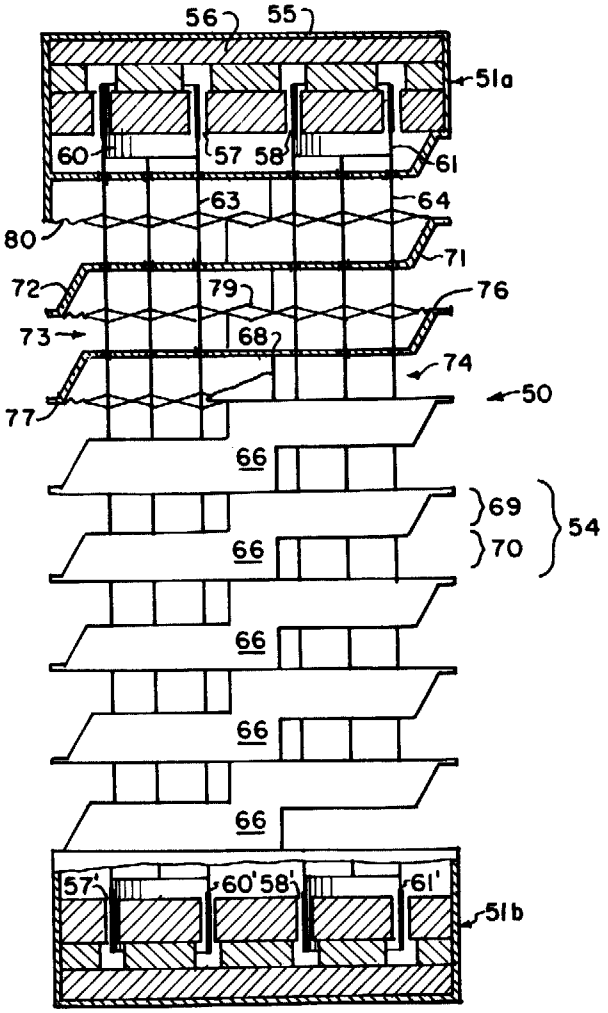
FIG. 6 is an elevational sectional view of the electro-acoustic transducer of FIG. 5 taken at lines 6—6.
Figure 5:
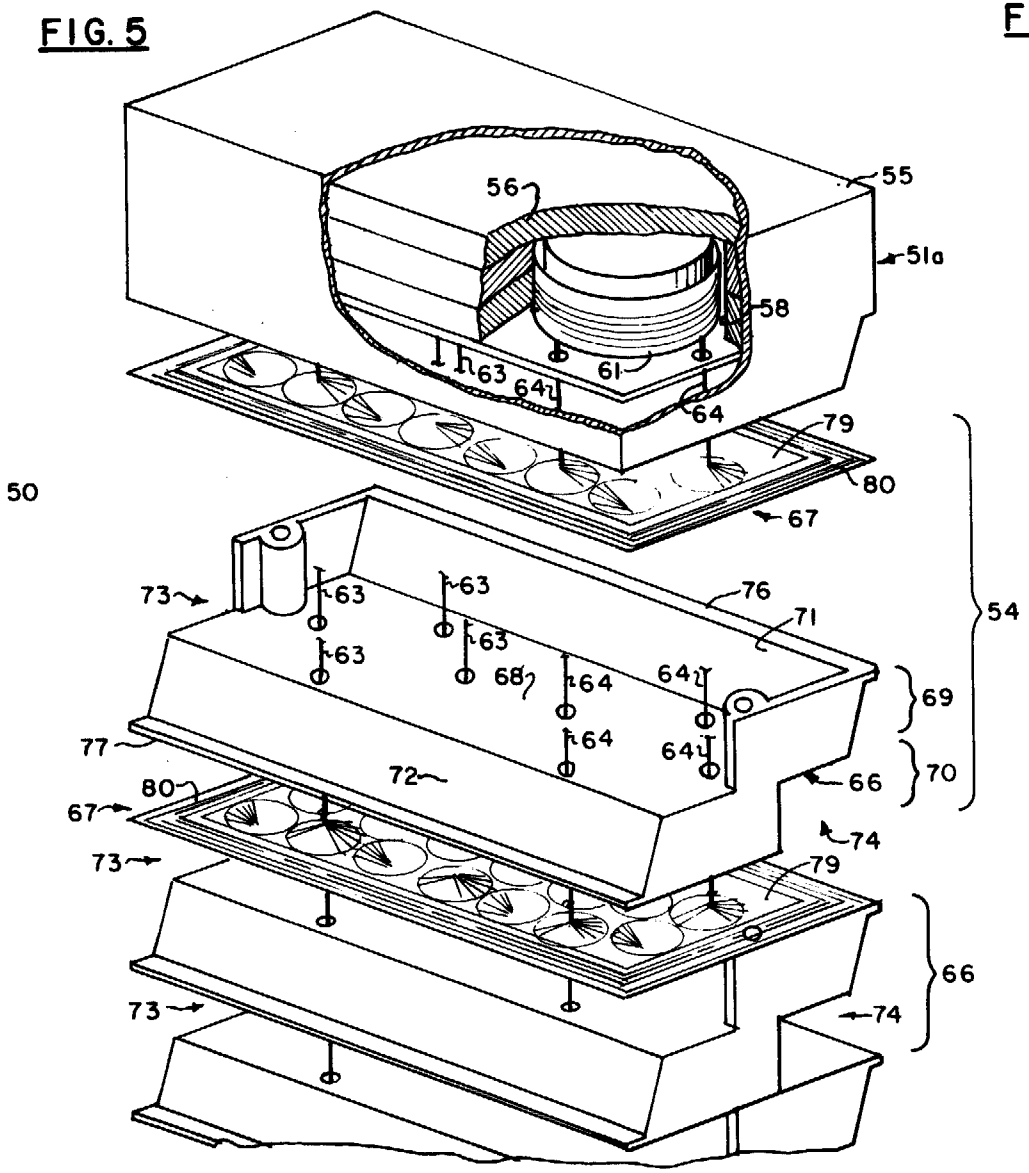
FIG. 5 is an isometric exploded view of a second embodiment of the electro-acoustic transducer of the present invention showing the use of rectangular diaphragms.

With particular reference to FIG. 5, there is shown an exploded view of the top portion of double ended drive transducer 50 which is shown as a partial cut-away elevational view in FIG. 6.

Transducer 50 comprises an upper and lower drive assembly 51*a* and 51*b*, respectively, between which are disposed a plurality of modular transducer assemblies 54.

Both upper and lower drive assemblies 51*a* and 51*b* are identical and, for the purpose of description, the suffix letters will not be used when referring generally to these drive assemblies.

Drive assemblies 51 comprise, basically, a housing 55 containing a magnet assembly 56 containing two cylindrical gaps 57 and 58 adapted to receive cylindrical drive coils 60 and 61, respectively. A plurality of drive rods 63 and 64 are connected to drive coils 60 and 61, respectively, at one end and to drive coils 60' and 61' at their other end.

Between upper drive assembly 51*a* and lower drive assembly 21*b* are disposed a plurality of transducer modules 54, each of which comprises a molded spacer and fixed diaphragm unit 66 and a movable diaphragm unit 67.

Spacer-fixed diaphragm unit 66 comprises a fixed diaphragm 68 defining a plane dividing unit 66 into upper and lower halves 69 and 70, respectively, with each half enclosed by oppositely disposed upper and lower acoustic housing or barriers 71 and 72, respectively, each defining oppositely facing upper and lower openings 73 and 74, respectively, on oppsite sides of diaphragm 68.

Figure 7:
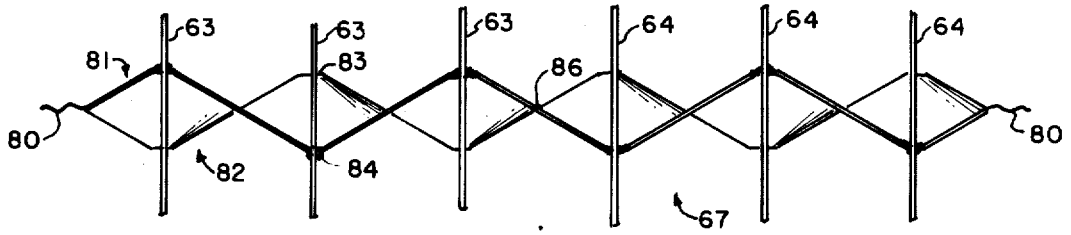
FIG. 7 is a sectional view of the typical movable diaphragm of the electro-acoustic transducer of FIGS. 5 and 6.

Attached to the top surface or edge 76 of upper acoustic barrier 71 and the bottom surface or edge 77 of lower acoustic barrier 72 between each spacer-fixed diaphragm unit 66, is movable diaphragm unit 67 comprising a generally planar diaphragm 79 that has been rigidized or deformed to achieve a rigid unit. A flexible membrane 80 is connected between diaphragm 79 and surfaces 76 and 77 to allow ample movement of diaphragm 79 toward and away form fixed diaphragm or surface 68 although, provided certain precautions are taken, a narrow space without membrane 80 can also be used as described below. Movable diaphragm unit 67 is shown in greater detail in FIGS. 7 and 8 with FIG. 7 showing a section through a typical diaphragm unit 67 taken at lines 7—7 for the isometric view of diaphragm unit 67 shown in FIG. 8.

Movable diaphragm 67, in particular, comprises a plurality of alternately upward and downward protruding rigidizing nodes 81 and 82, respectively, arranged in ordered array so that drive rods 63 and 64 are attached thereto at the apex 83 or nadir 84 of each node 81 and 82 respectively.

It has been found that satisfactory rigidity is achieved if nodes 81 and 82 define conical sections with a surface geometry between cones analogous to that of an elastic surface connecting the bases of the cones.

For example, if an elastic surface or sheet were stretched between the bases of cones represented by nodes 81 and 82, the curved surface or saddle 86 would result. This elastic sheet could be defined by a metallic sheet deformed under hydraulic pressure which is used as the mold for a plastic or paper diaphragm.

Of course, other surfaces could be used which are defined by a mathematical equation such as for hyperbolic paraboloids which may also be used to rigidize diaphragm 67.

Figure 9:
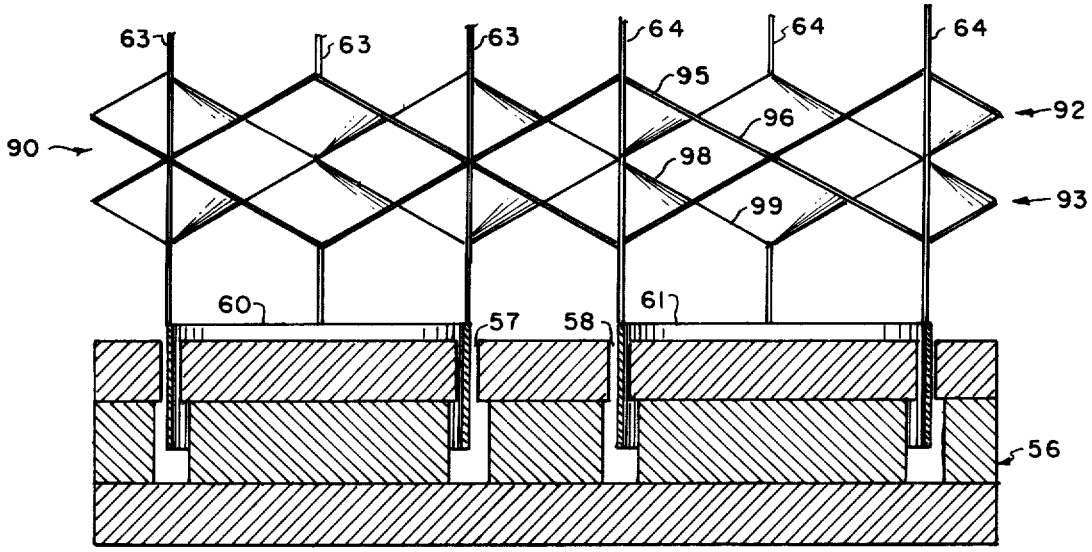
FIG. 9 is an elevational sectional view of a first embodiment of a rigid base diaphragm.

To achieve even greater rigidity of the movable diaphragm unit comprising diaphragms 67 and drive rods 63, a rigid base diaphragm 90 can be used as illustrated in FIG. 9.

Figure 8:
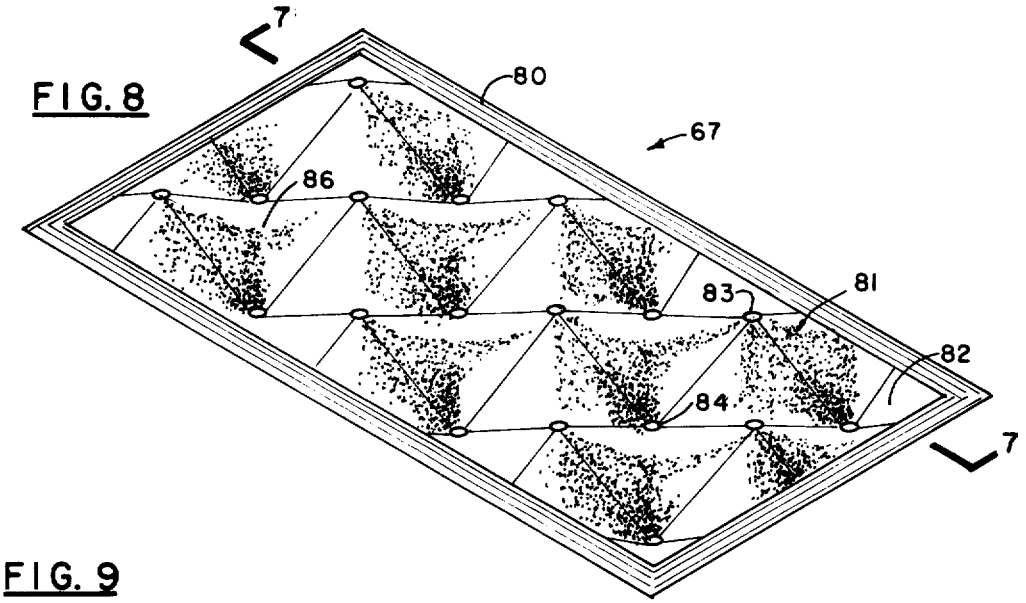
FIG. 8 is an isometric view of a typical movable diaphragm of the electro-acoustic transducers of FIGS. 5 and 6.

Base diaphragm 90 comprises an upper rigidized movable diaphragm 92 and a lower rigidized diaphragm 93, each of which is identical in structure and shape to movable diaphragm 67 of FIG. 8.

Upper diaphragm 92, similar to diaphragm 67, comprises a plurality of alternately upward and downward protruding nodes 95 and 96, respectively, arranged in an ordered array.

Lower diaphragm 93, also similar to diaphragm 67, comprises a plurality of alternately upward and downward protruding nodes 98 and 99, respectively, arranged in ordered array with upward protruding nodes 98 of lower diaphragm 93 attached to downward protruding nodes 96 of upper diaphragm 92.

Cylindrical drive coil 60 is attached to drive rods 63 while drive rods 64 are connected to drive coil 61 thus providing a rigid connection, with drive rods 63 and 64 attached to the peaks of upward and downward nodes of diaphragms 92 and 93 in order to distribute the forces over the surface of diaphragms 67.

It can be seen that such a construction defines a plurality of cantilevered units offering a very rigid structure.

Figure 10:
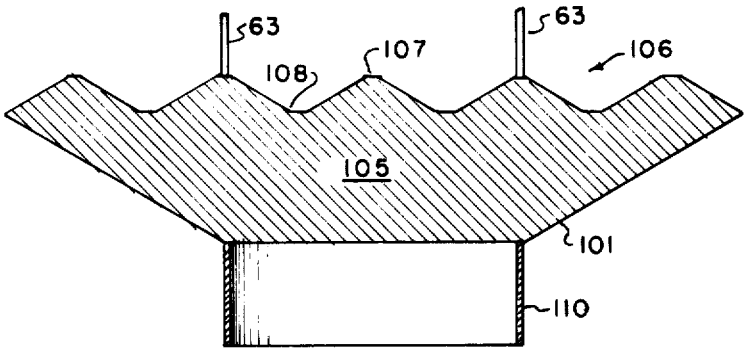
FIG. 10 is an elevational sectional view of a second embodiment of a rigid base diaphragm.

A second method of achieving greater rigidity is shown in FIG. 10 in which a conical section is molded from a light weight foam plastic, common in the art, such as polystyrene, to define a rigid base 105 comprising a top surface 106 having a plurality of upward and downward protruding peaks 107 and valleys 108, respectively, identical in shape to nodes 83 and 84 of diaphragms 67 of FIG. 8 and a frusto-conical body portion 101 to which is attached a cylindrical drive coil 110.

It can be seen that the forces transmitted by drive coil 110 are distributed over top surface 106, which in turn are distributed equally among drive rods 63 and thus distributed over the surface of diaphragms 67 (FIG. 5).

Double ended drive transducer 50 operates in the same manner as electro-acoustic transducer 10 previously described, however, a number of advantages are achieved, in particular, the use of driving coils as each end of drive rods 63 and 74 permit a greater number of modular transducer assemblies 54 to be utilized in one unit when compared to the number of acoustic transducer sections 12 that can be used in electro-acoustic transducer device 10.

Movable diaphragm unit 67 can be fabricated from any light weight material having good tensile and compressive strength properties such as layered cellulose fibers or paper pulp similar to the material used in cone speakers of the prior art or polyethylene, acrilic or similar plastic material well known in the art.

Fixed diaphragm-spacer unit 66 can be fabricated, for example, by injection molding techniques from similar plastic materials well known in the art.

With respect to the use of flexible membrane 80 (FIG. 5) and flexible membrane 33 (FIG. 2), as mentioned previously, the need for such membranes may not be necessary, in fact, the absence of such a membrane is desirable.

In the case of membrane 33, which is used for a circular diaphragm, the use of a circular membrane introduces non-linear forces at the periphery of movable diaphragm 23 causing certain types of harmonic distortion to develop analogous to the distortions found in other vibratory diaphragms such as drum heads.

The matter is somewhat improved by the use of rectangular membrane 80 incorporated in the embodiment illustrated in FIG. 5.

In FIG. 5, the forces caused by the elastic deformation of membrane 80 still cause certain harmonic distortions to develop but on a smaller scale.

Figure 11:
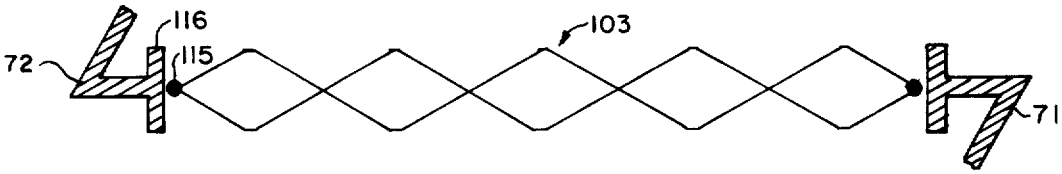
FIG. 11 is an elevational sectional view of the movable diaphragm configuration of FIGS. 7 and 8 showing the beaded edge configuration in greater detail.
Figure 12:
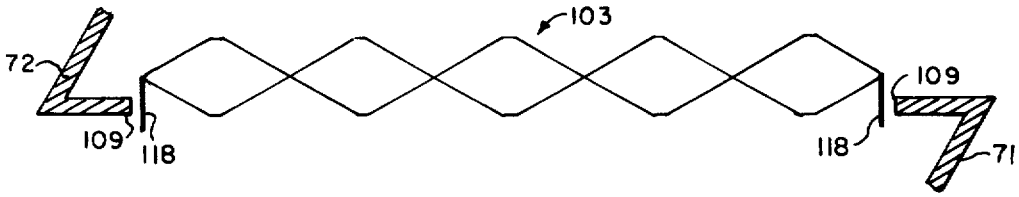
FIG. 12 is an elevational sectional view of the movable diaphragm configuration of FIGS. 7 and 8 showing the vertical tip edge configuration in greater detail.

Two embodiments illustrating movable diaphragm configurations without a membrane connecting the movable diaphragm to the fixed portion of the transducer are shown in FIGS. 11 and 12.

In FIG. 11, movable diaphragm 103 is identical in structure to diaphragm 67 of FIG. 5, however, with the exception that a reinforcing bead 115 is connected to or incorporated about the periphery of diaphragm 103 to further rigidize the diaphragm. Further, a lip 116 is provided proximate reinforcing bead 115 which is attached to acoustic barrier 71 and 72.

To avoid too great a loss in sound volume and efficiency, the spacing bead 115 from lip 116 should be generally no greater than a fraction of a millimeter preferably less than 1 mm.

The length of lip 116 is determined by the maximum displacement of movable diaphragm 103 which in turn is determined by the length of the magnetic gap of magnet assembly 56 (FIG. 5).

In FIG. 12, movable diaphragm 103 is provided with reinforcing wall or barrier 118 rather than a bead which performs the dual function of further rigidizing the diaphragm and providing a barrier to prevent air from leaking past lip 109 when diaphragm 103 is at its upper or lower limit of travel, which travel is normally greater than the width of thickness of lip 109.

Similar to FIG. 11, the spacing of barrier 118 from lip 109 should be preferably smaller than 1 millimeter. The criteria being, in all cases, that the spacing should be small enough to offer a sufficient resistance to the passage of air around the diaphragm to avoid an undesirable loss in efficiency of the transducer.

A third embodiment of the low frequency electro-acoustic transducer 210 of the present invention is illustrated in FIGS. 13 through 17.

Figure 13:
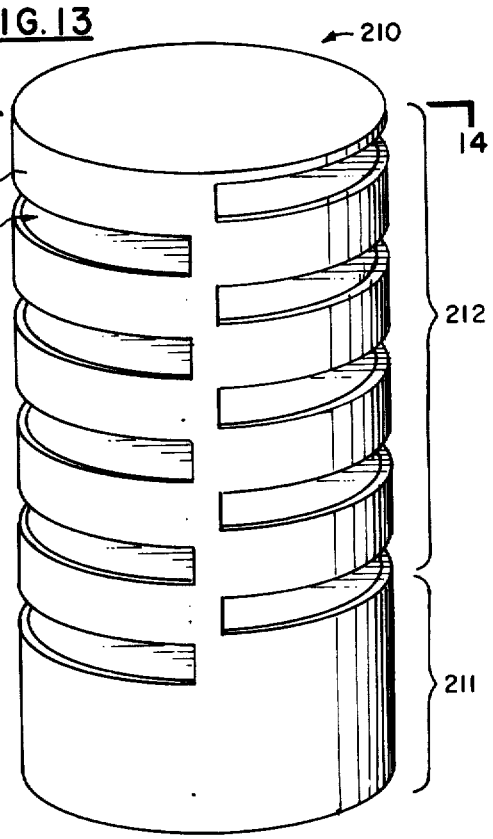
FIG. 13 is an isometric overall illustration of a cylindrical configurtion of the low frequency electro-acoustic transducer of the present invention.

With reference to FIG. 13, the electro-acoustic transducer 210 comprises, basically, a driver section 211 above which is mounted a cylindrical acoustic transducer or air motion transformer section 212, two sections being enclosed in a cylindrical housing member 214.

Figure 14:
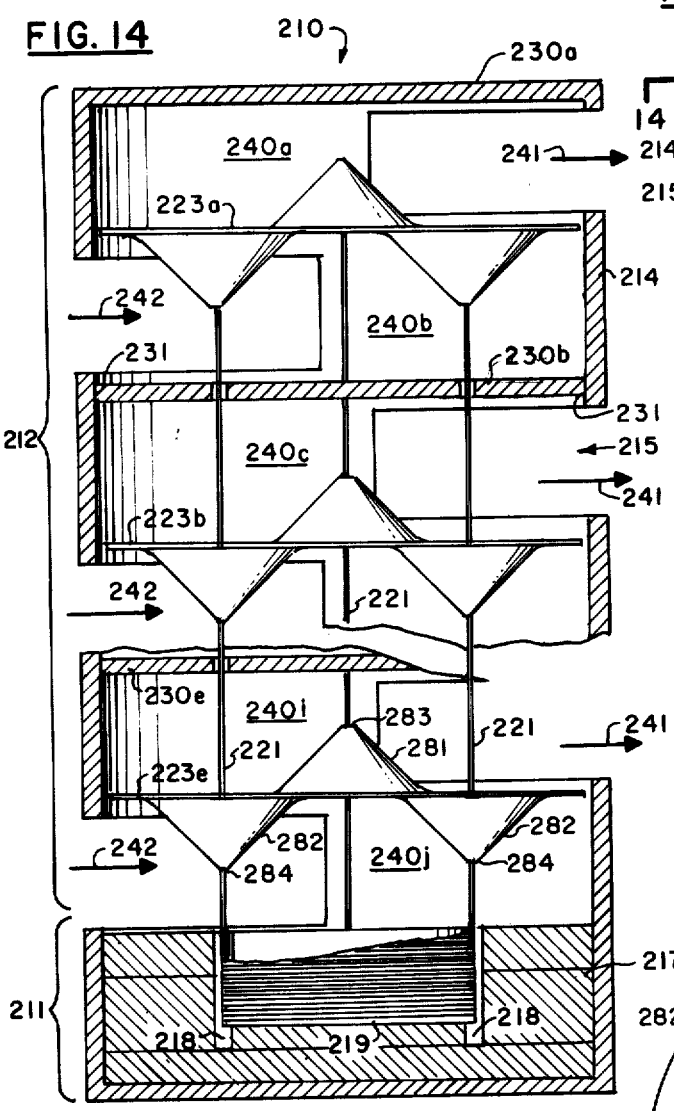
FIG. 14 is an elevational sectional view of the cylindrical speaker of FIG. 13 taken at line 14—14.

With reference to FIG. 14, cylindrical housing member 214 comprises a plurality of radially disposed, semi-cylindrical slots 215 facing in opposite directions and alternately disposed at equal intervals along housing 214, with the exception of that portion of housing 214 occupied by driver section 211.

Driver section 211 comprises a permanent magnet assembly 217 having an air gap 218 in which is disposed driver coil 219.

Acoustic transducer or air motion transformer section 212 comprises, basically, a plurality of movable diaphragms 223 (one of diaphragms **223*a* - 223*e*) connected through drive rods 221 to drive coils 219 with a like plurality of fixed diaphragms 230 (one of diaphragms 230*a* - 230*e*) disposed alternately between movable diaphragms 223 and attached to housing 214. In particular, fixed diaphragms 230 are attached to housing 214 at the connector portion 231 between each slot 215 to define a cavity or space 240 open at slot 215 and bounded by fixed diaphragm 230, connector portion 231 and movable diaphragm 223**.

Figure 15:
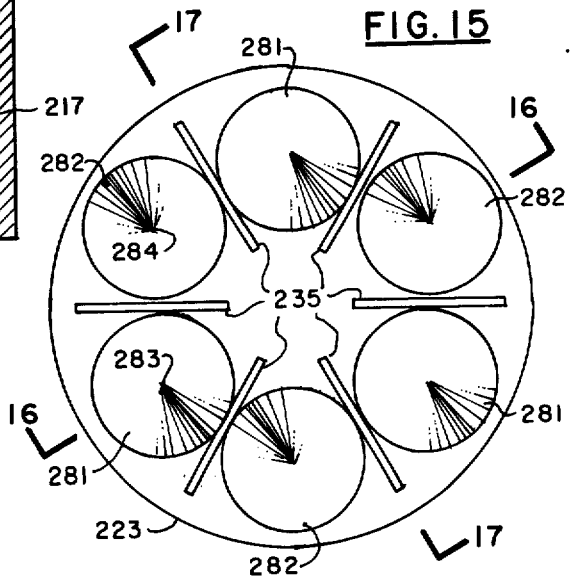
FIG. 15 is a top view of a typical movable diaphragm as used in the cylindrical low frequency electro-acoustic transducer of FIGS. 13 and 14.

Movable diaphragm 223 is shown in greater detail in FIG. 15 and comprises a plurality, six in the embodiment illustrated, of alternately upward and downward protruding rigidized nodes 281 and 282, respectively, arranged in a circular array so that drive rods 221 are attached thereto at apex 283 on nadir 284 of each node 281 and 282, respectively.

Typically, nodes 281 and 282 can define 90 degree cones, i.e., the angle at the apex of the cone is a right angle.

Figure 17:
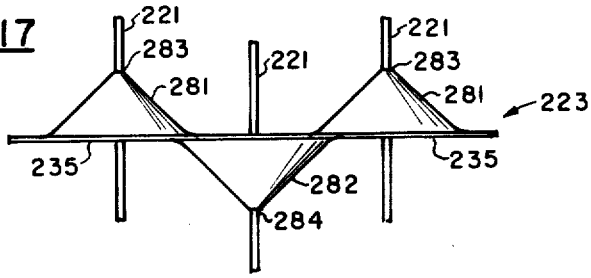
FIG. 17 is an elevational sectional view of the movable diaphragm of FIG. 15 taken at line 17—17.

It has been found that satisfactory rigidity is achieved if nodes 281 and 282 define conical sections with the transition from upward to downward projecting nodes (cones) is arranged so that a straight and level line can be drawn between cones, as for example, along cut lines 17—17 of FIG. 15, as also can be seen from FIG. 17.

Even with drive rods 221 attached to the apex 283 and nadir 284 of each node 281 and 281, respectively, certain undesirable resonances and harmonic distortions may be developed within the geometry of movable diaphragm 223 and within conical nodes 281 and 282 similar to the resonances described above for large cone drive speakers of the prior art.

In the present invention, because the conical nodes 281 and 282 are small, the resonance or distortion is small, however, even these harmonic distortions can be eliminated by the use of slots 235 disposed along the straight line section between conical nodes 281 and 282, as can be seen in FIG. 15. Each slot 235 is filled with viscous material such as to prevent any vibrational distortion from traveling between conical nodes 281 and 282.

Typically, movable diaphragms 223 are fabricated from a generally stiff plastic material such as polystyrene or the like. For a three inch diameter diaphragm, the weight of the diaphragm will be, typically, about 1 gram.

Figure 16:
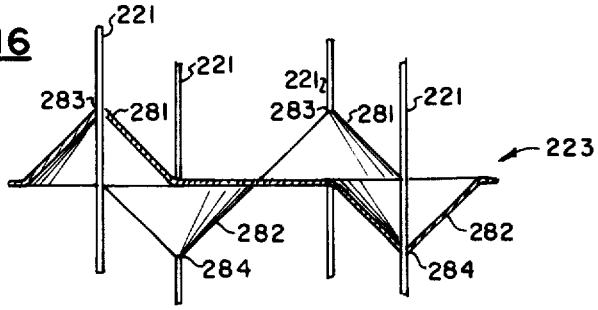
FIG. 16 is an elevational sectional view of the movable diaphragm if FIG. 15 taken at line 16—16.

With reference to FIG. 16, there is illustrated a section through both upward and downward projecting nodes 281 and 282, respectively, showing their conical shape and the shape of the transition section between conical sections.

With reference to FIG. 17, there is illustrated a section through movable diaphragm 223 taken at line 17—17 of FIG. 15. The section is taken through slots 235 and illustrates the geometry of movable diaphragm 223 where a straight and level line can be drawn across diaphragm 223 between conical sections.

As can be seen from FIG. 14, the diameter of drive coil 219 is arranged to be coincident with the diameter of the circle defined by the apexes of nodes 281 and 282 so that coil 219 can be attached directly to nodes 282 and the surface of diaphragm **223*e* including the underside of node 281 and also be coincident at each apex 283 and 284 with the point of attachment of the drive or push rods 221**.

Operation of electro-acoustic transducer 210 illustrated in FIGS. 13-17 is basically one of applying an alternating direction force to diaphragms **223*a*-223*e* by means of the application of an alternating current to drive coil 219, which causes diaphragms 223*a*-223*e* to move alternately toward and away from fixed diaphragms 230*a*-230*e* to drive air in and out of cavity or space 240 between each fixed diaphragm 230*a*-230*e* and movable diaphragm 223*a*-223*e***, respectively.

For example, when movable diaphragm 223b is moved upward toward fixed diaphragm 230b, there is a compression of the air mass between diaphragm 223b and 230b causing air to flow out of cavity 240c, as indicated by arrow 241, while, at the same time, there is a rarefaction of the air mass between diaphragm 223a and 230b, below diaphragm 223a causing a flow of air into cavity 240b, as indicated by arrow 242.

Thus, a large amount of air is moved with a relatively small amount of kinetic energy.

Figure 19:
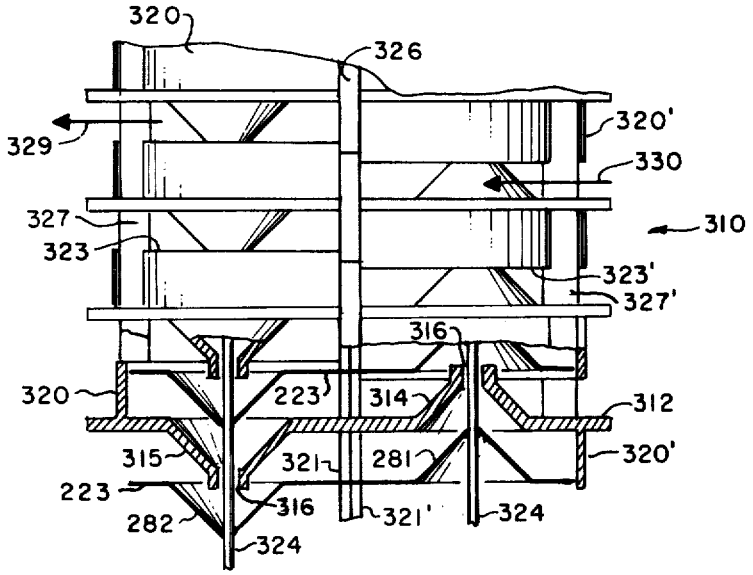
FIG. 19 is a partial sectional elevational view of a typical cylindrical low frequency electro-acoustic transducer utilizing the modular fixed diaphragm units of FIG. 18 and the movable diaphragm units as illustrated in FIGS. 15-17.
Figure 18:
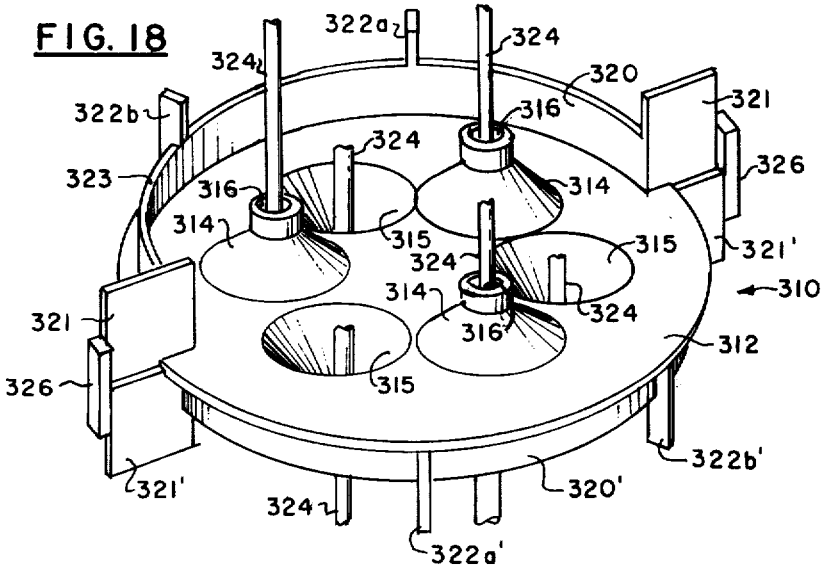
FIG. 18 is an isometric view of a typical movable-fixed diaphragm unit to achieve a cylindrical low frequency electro-acoustic transducer.

For the purpose of simplifying the method of manufacturing the air motion transformer section 212 of FIGS. 13 and 14, this section can comprise a plurality of modular fixed diaphragm units 310, as shown in FIG. 18, which are adapted to stack as shown in FIG. 19. Between each stacked unit 310 is disposed a movable diaphragm 223, the same as shown in FIGS. 16 and 17.

With reference to FIG. 18, fixed diaphragm unit 310 comprises a generally planar fixed plate portion 312, having deformed therein six equi-angularly spaced alternately upward protruding noes or cones 314a–314c and downward protruding nodes or cones 315a–315c.

Nodes or cones 314 and 315 are arranged in the same realtive location as nodes or cones 281 and 282, respectively, or movable diaphragm 223 so that, when diaphragm 223 is in position, upward protruding nodes or cones 314 of fixed diaphragm 310 and upward protruding nodes or cones 281 of movable diaphragm 223 will tend to nest, that is, be spaced apart but still fit or mate with each other. In a like manner downward protruding nodes or cones 282 of movable diaphragms 223 and downward protruding nodes or cones 315 of the next fixed diaphragm 310 below, will tend to nest.

At the apex of both cones 314 and 315 is a hole 316 and 317, respectively, defined by short cylindrical section 318 and 319, respectively.

A semi-cylindrical acoustic barrier 320 is disposed on the top surface of planar portion 312 terminating at each end by an upper end spacer 321 whose end surface is coincident with the diameter of circular planar portion 312.

Two intermediate spacer members 322a and 322b are disposed at equal intervals about acoustic barrier 320.

Disposed on the lower or underside of planar portion 312 is an identical configuration as that described above for the upper side, only positioned diametrically opposite the upper configuration.

For example, acoustic barrier 320', end spacer member 321' and intermediate spacer 322a' and 323b' (not shown) perform the same function as their counterpart above.

It will be noted that the height of end spacer 321 and intermediate spacers 322a and 322b are greater than the height of acoustic barrier 321 above planar portion 312. This greater height, that is, the difference in height between spacers 321, 322a and 322b znc barrier 320, determine the width of the opening of slot 215, (FIG. 13) for air motion transformer section 212 (FIGS. 13 and 14).

It will also be noted from FIG. 19, that the top lip 323 of acoustic barrier 320 extends above corresponding lip 323' of acoustic barrier 320' of the next fixed diaphragm unit 310 above. This difference or "overlap" determines the maximum distance the movable diaphragms 223 will move within the assembled fixed diaphragm units 310.

It should be noted that the outside diameter of movable diaphragm 223 is slightly less than the inside diameter of assembled acoustic barrier 320 and 320' such that diaphragm 223 moves up and down in the manner of a piston without touching or being connected to the walls of acoustic varrier 320 and 320'.

To assemble an air motion transformer section as shown in FIG. 19, fixed diaphragm units 310 and movable diaphragm 223 are alternately stacked as follows:

Movable diaphragm drive rods 324 which are attached at one end to drive coil 219 (not shown in FIG. 19) are arranged to pass through holes 316 in cone sections 314 of fixed diaphragm unit 310 and be freely movable therein and extend upward for length corresponding to the number of movable diaphragms 223 being used for an air motion transformer section 212.

The bottom fixed diaphragm unit 310 is attached by means common in the art to the magnet assembly 217 (FIG. 14) by means well known in the art.

Next movable diaphragm 223 is placed so that the drive rods 324 will pass through the apex 283 of nodes 281 and the apex 284 of nodes 282.

Movable diaphragm 223 is adjusted along drive rods 324 until it is properly spaced from fixed diaphragm 310 at which point it is attached to drive rods 324 by means well known in the art such as an adhesive or glue.

A second fixed diaphragm unit 310 is then placed so that drive rods 324 will pass freely through holes 316 of cones 314 in fixed diaphragm unit 310 while drive rods 324 pass through holes 317. Diaphragm unit 310 is then adjusted along the rods until the top of end spacer 321 and intermediate spacers 322a and 322b of the lower diaphragm unit 310 come in contact with the underside of planar portion 312 of the upper diaphragm unit 310 and until the bottom of end spacers 321' and intermediate spacers 322a' and 322b' come in contact with the top surface of planar portion 312 of the lower diaphragm unit 310.

An adhesive or glue is applied to the surfaces of spacers 321 and 321' and intermediate spacers 322a, 322b, 322a' and 322b' where they contact the next modular section 310 to achieve a unified and rigid structure.

Thus, it can be seen from FIG. 19, a slot 327 is defined between lips 323 and the underside of planar portion 312. Correspondingly, slot 327' is defined between lips 323' and the upper side of planar portion 312 of the next lower diaphragm unit 310.

Therefore, an upward movement of drive rods 324 will result in air being forced out of slot 327 to the left, as indicated by arrows 329, while, at the same time, air is drawn or pulled into slot 327' from the right, as indicated by arrows 330.

Thus, air motion transformation is chieved whereby a small movement of diaphragm 223 causes a large movement of air in and out of slots 327 and 327'.

I claim:

1. A low frequency electro-acoustic transducer comprising a plurality of spaced apart, generally parallel arranged, alternately disposed fixed and movable diaphragms defining a plurality of narrow air spaces having open sides facing in opposite directions, each of said fixed diaphragms comprising, a first acoustic barrier disposed generally parallel and spaced apart from said movable diaphragm, a second barrier attached to said first acoustic barrier and extending approximately one-half the periphery of said first acoustic barrier and depending upwardly therefrom, a third acoustic barrier attached to said first acoustic barrier and depending downwardly therefrom oppositely disposed from said second barrier, means for stacking and connecting like fixed diaphragms to each other to define a stack of fixed diaphragms, said stack defining said plurality of narrow air spaces having open sides facing in opposite directions, each of said movable diaphragms comprising, a sheet member having disposed thereon a plurality of upwardly and downwardly protruding cones arranged in ordered array, each cone having an apex and a base, disposed with said bases adjacent one another, and means connected at the apex of at least three of said cones for moving said movable diaphragm alternately toward and away from said fixed diaphragm.

* * * * *